US011346329B2

(12) United States Patent
Lozano et al.

(10) Patent No.: US 11,346,329 B2
(45) Date of Patent: May 31, 2022

(54) PROPULSION SYSTEMS INCLUDING AN ELECTRICALLY ACTUATED VALVE

(71) Applicant: Massachusetts Institute of Technology, Cambridge, MA (US)

(72) Inventors: Paulo C. Lozano, Arlington, MA (US); Dakota Freeman, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 346 days.

(21) Appl. No.: 16/427,179

(22) Filed: May 30, 2019

(65) Prior Publication Data

US 2020/0378371 A1 Dec. 3, 2020

(51) Int. Cl.
*F03H 1/00* (2006.01)
*B05B 5/16* (2006.01)

(52) U.S. Cl.
CPC ..... *F03H 1/0037* (2013.01); *B05B 5/1608* (2013.01)

(58) Field of Classification Search
CPC ..... F03H 1/0012; F03H 1/005; F03H 1/0037
See application file for complete search history.

(56) References Cited

U.S. PATENT DOCUMENTS

2011/0007446 A1 1/2011 Song
2016/0297549 A1* 10/2016 Lozano ..... F03H 1/0012
2019/0135457 A1* 5/2019 Lozano ..... B64G 1/405
2019/0264666 A1* 8/2019 Lozano ..... F03H 1/0012

OTHER PUBLICATIONS

Invitation to Pay Additional Fees dated Jul. 23, 2019 in connection with International Application No. PCT/US2019/034591.
PCT/US2019/034591, dated Jul. 23, 2019, Invitation to Pay Additional Fees.

* cited by examiner

*Primary Examiner* — Arun Goyal
*Assistant Examiner* — William L Breazeal
(74) *Attorney, Agent, or Firm* — Wolf, Greenfield & Sacks, P.C.

(57) ABSTRACT

Propulsion systems, such as electrospray thrusters, may include an electrically actuated valve to permit a selective flow of propellant to a thruster. The valve may be located and arranged such that it physically separates a propellant, such as a source of ions, from a thruster of the propulsion system. In some embodiments, the application of a voltage potential to the valve may wet a plurality of through holes formed in the valve with the propellant such that the propellant flows through the valve to the thruster. After the valve has been opened, the propulsion system may be operated normally.

22 Claims, 6 Drawing Sheets

PROPULSION SYSTEMS INCLUDING AN ELECTRICALLY ACTUATED VALVE

GOVERNMENT SUPPORT

This invention was made with Government support under Grant No. NRO000-13-C-0516 awarded by the National Reconnaissance Office (DOD). The Government has certain rights in the invention.

FIELD

Embodiments related to propulsion systems including an electrically-actuated valve as well as their methods of use and manufacture are disclosed.

BACKGROUND

Propulsion systems utilizing propellants may be actively fed (e.g., using pressure) or passively fed (e.g., using capillary forces). For example, electrospray thrusters, also known as electrospray emitter devices, are propulsion systems that produce thrust by accelerating ions from a source of ions in response to an applied potential above which Taylor Cone formation occurs. Some electrospray emitter devices use capillary forces to passively feed the emitter(s) with liquid propellant. The propellant (e.g., a source of ions) used in these electrospray emitters may be an ionic liquid, or other appropriate fluid, and may allow for a scalable specific impulse in some electrospray emitters for times of approximately 500 seconds to 5000 or more seconds. Depending on the application, a plurality of electrospray emitters can be arranged together (e.g., in a line or in an array) to produce a predetermined thrust, for use in applications such as space propulsion applications. Such emitters may be manufactured using a number of different fabrication techniques.

SUMMARY

In one embodiment, a propulsion system includes a reservoir containing a propellant, a thruster, and at least one valve disposed between the reservoir and the thruster. The at least one valve includes a first plurality of through holes extending from a first side of the at least one valve to a second side of the at least one valve opposite the first side. The propulsion system also includes a first power source electrically connected to the propellant and the at least one valve. In a first initial operating mode the plurality of through holes of the at least one valve are substantially free of the propellant, and in a second operating mode the first power source applies a voltage potential to the at least one valve relative to the propellant to wet the first plurality of through holes of the at least one valve with the propellant to place the reservoir in fluid communication with the thruster.

In another embodiment, a propulsion system includes a reservoir containing a propellant, a thruster, and at least one valve disposed between the reservoir and the thruster. The at least one valve includes a substrate comprising a plurality of through-holes, an insulating layer disposed on a surface of the substrate and disposed on a surface of the through-holes, and a hydrophobic layer disposed on at least an upstream surface of the substrate. The hydrophobic layer is more hydrophobic than the insulating layer and the substrate, and the hydrophobic layer is disposed on the insulating layer. The propulsion system also includes a first power source electrically connected to the propellant and the at least one valve.

In yet another embodiment, a method of operating a propulsion system includes: applying a voltage potential to a substrate of at least one valve relative to a propellant; and wetting a plurality of through holes extending from a first side of the at least one valve to a second side of the at least one valve opposite the first side in response to the applied voltage potential to place the propellant in fluid communication with a thruster.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF THE DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
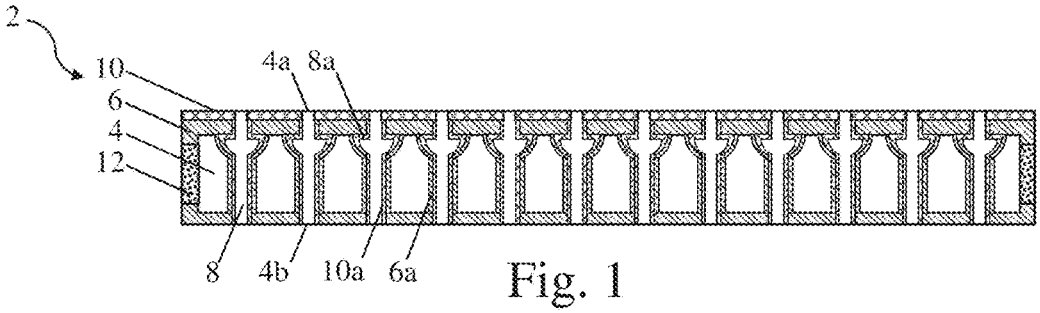
FIG. 1 is a schematic diagram of one embodiment of an electrically actuated valve.

Propulsion systems (e.g., electrospray thrusters) are devices that may be used to provide mobility to spacecraft once the thrusters leave the atmosphere of the earth. Electrospray thrusters may feature a number of advantages over more conventional forms of space propulsion, including high compactness and performance. Important phases of the deployment of propulsion systems in space systems may include storage of propulsion systems within the atmosphere of the earth at ground level, which may be quite prolonged, and the launch itself, in which rocket payloads are exposed to fast de-pressurization and severe vibrations. However, during both storage and during the aggressive conditions experienced during launch, the propellant may either leak from the system and/or be exposed to the gases present in an exterior environment. Additionally, once deployed, the surrounding vacuum environment may cause gases dissolved and/or trapped in the system to expand as the atmospheric pressure quickly changes from sea-level values to a pressure of less than or equal to about 1 milliTorr (i.e. about 0.13 Pascals) in under two minutes. This release and expansion of gas creates pressure within a propellant reservoir of the propulsion system which may result in the uncontrolled flow of liquid propellant through the system which may bridge the gap between an electrospray thruster and an associated extractor electrode. This may, thus, produce short circuits and device failure.

In view of the above, the Inventors have recognized that it may be desirable to isolate a propellant reservoir from an exterior environment during storage and/or launch of a propulsion system prior to deployment of the propulsion system. Specifically, the Inventors have recognized the benefits associated with the use of an electrically-actuated valve that prevents leakage of propellant from a propulsion system by physically isolating a propellant within a propellant reservoir from a thruster and/or the surrounding environment. Specifically, the valve may be operated such that in an initial condition, the valve isolates the propellant from the associated thruster. When a flow of propellant from the reservoir to the thruster is desired, a voltage potential may be applied to the valve to wet a plurality of through holes formed in the valve with the propellant such that the propellant may flow from the propellant reservoir to the thruster through the valve. Thus, in some embodiments, a valve may operate using the principle of electrowetting, in which a material that otherwise is non-wettable by a conductive liquid becomes wettable by the conductive liquid after a charge is applied to the valve to electrostatically polarize an interface between the conductive liquid and a surface of the valve. This polarization may be achieved by applying an actuation voltage to a substrate of the valve which may include one or more insulating and/or hydrophobic layers disposed thereon to provide the desired functionality.

In one embodiment, a propulsion system may include a reservoir containing a propellant, a thruster, such as an electrospray thruster, and at least one valve disposed between the reservoir and the thruster such that the valve is disposed along a flow path extending between the reservoir and the thruster. The at least one valve may include a plurality of through holes that extends from a first side of the at least one valve to a second side of the at least one valve, where the second side of the valve is located opposite the first side. The propulsion system may also include a power source that is electrically connected to the propellant is in any appropriate configuration. The power source may also be electrically connected to the at least one valve. In a first initial operating mode, the plurality of through holes of the last one valve may be substantially free of, or not wetted by, the propellant. Accordingly, in this operating mode, the valve may prevent the flow of propellant from the reservoir to the thruster. In a second operating mode, the power supply may apply a voltage potential to the at least one valve relative to the propellant located in the reservoir. The applied voltage potential may cause the propellant to wet the plurality of through holes formed in the at least one valve. Once the plurality of through holes are wet with the propellant, the propellant may flow from the reservoir through the valve to the thruster.

In another embodiment, a propulsion system may include a reservoir containing a propellant, a thruster, such as an electrospray thruster, and at least one valve disposed between the reservoir and the thruster. The at least one valve may include a substrate with a plurality of through holes formed therein, an insulating layer disposed on an exterior surface of the conductive substrate and within the through holes, and a hydrophobic layer disposed over at least a surface of the substrate contacting the propellant. The hydrophobic layer may be more hydrophobic than the insulating layer and the substrate. Additionally, in some embodiments, a power source may be electrically connected to the propellant and the at least one valve to apply a voltage potential to the valve relative to the propellant to selectively wet the plurality of through holes with the propellant.

Depending on the particular embodiment, an electrically actuated valve may be integrated into a propulsion system as a separate device disposed between a thruster and an associated propellant reservoir of a propulsion system. Alternatively, in other embodiments, the electrically actuated valve may be integrally formed with one or more components of a propulsion system. For example, a support for a thruster may include an electrically actuated valve integrally formed with the support. This may simplify the integration of the electrowetting valve into a propulsion system, as well as simplifying electrical connections with the system. Additionally, due to the compact construction of the disclosed electrically actuated valves, in some embodiments multiple valves may be used in series with one another. In such an embodiment, a plurality of valves may be disposed on one another such that they are located in series between a thruster and an associated propellant reservoir such that propellant flows from the reservoir through the plurality of valves and to the thruster. This may provide redundancy in the isolation of a propellant reservoir from an associated thruster. In view of the foregoing, it should be understood that the various embodiments of electrically actuated valves disclosed herein may be integrated into a propulsion system in any appropriate way and any number of valves may be used in a particular propulsion system as the disclosure is not limited in this manner.

The compact construction of the disclosed valves as well as their simple actuation using an applied voltage potential offer multiple potential benefits for various types of propulsion systems. For example, the disclosed valves may be easily integrated into any number of different propulsion systems during the fabrication of the propulsion system itself. Alternatively, the disclosed compact valves may also be easily integrated into a flow path extending between a propellant reservoir and a thruster. In either case, the proposed valves may provide the desired functionality while offering a compact construction and small weight addition. It is also expected that the disclosed valves may facilitate reliable operation of thrusters without adding serious complexity to their design. Of course, while several potential benefits are listed above, it should be understood that embodiments in which not all of the listed benefits and/or different benefits are provided by a valve are also contemplated as the disclosure is not limited to only the listed benefits.

It should be understood that the various embodiments of valves disclosed herein may include a number of different layers and/or substrates. These layers and/or substrates may be made using any appropriate combination of materials to provide the desired functionality. However, in some embodiments, the materials and component constructions may also be selected such that they are compatible with the propellant contained in a reservoir of a propulsion system, capable of withstanding the rigors of a launch environment (e.g. vibration, shock, etc.), and/or capable of being integrated into small form factors.

In some embodiments, a substrate of a valve in the embodiments disclosed herein may correspond to any appropriate semiconducting or electrically conducting material. This may include: semiconductors such as silicon, germanium, and gallium arsenide; metallic materials such as copper, aluminum, gold, platinum, and stainless steel; non-conductive substrates such as glass, silica, quartz, various ceramics, polymers, and other non-conductive materials coated with a conductive material, combinations of the forgoing materials, and/or any other appropriate material. Accordingly, it should be understood that a substrate of a valve may be formed using any material with sufficient conductivity such that an electrical potential may be applied to the material relative to a propellant of a propulsion system to electrostatically polarize an interface of the valve to wet a plurality of through holes formed in the substrate with the propellant.

A substrate of a valve may have any appropriate thickness for a desired application. Appropriate thicknesses of a substrate may be greater than or equal to 50 μm, 100 μm, 200 μm, and/or any other appropriate thickness. Correspondingly, the thickness of the substrate may be less than or equal to 500 μm, 300 μm, 200 μm, and/or any other appropriate thickness. Combinations of the foregoing ranges are contemplated, including, for example, substrates with thicknesses between or equal to 50 μm and 500 μm. Of course, substrates with thicknesses both greater than and less than those noted above are contemplated as the disclosure is not limited to any specific substrate thickness.

To avoid the possibility of a dielectric breakdown and potential shorting within a valve of a propulsion system, it may be desirable to include an insulating layer between portions of the valve and other components of a propulsion system which may be at a different voltage potential (e.g. surrounding components and the propellant). Appropriate materials for the insulating layer may include any appropriate material with a sufficient dielectric constant and corresponding layer thickness capable of avoiding dielectric breakdown when exposed to the voltage potentials applied to the valve during either operation and/or when initially being opened. Exemplary materials may include, but are not limited to: oxides such as silicon dioxide ($SiO_2$), alumina ($Al_2O_3$), and oxides of the underlying substrate: nitrides such as silicon nitride and/or nitrides of the underlying substrate; nonconductive polymer layers such as a high-quality polytetrafluoroethylene (PTFE) layer, which in some embodiments may also function as a hydrophobic layer; and/or any other appropriate sufficiently insulating material capable of preventing dielectric breakdown and shorting within a valve during operation.

As noted above, an insulating layer may have any appropriate thickness depending on the particular material being used provide a desired amount of electrical insulation between a substrate of a valve and surrounding components of a propulsion system. In some embodiments, the insulating layer may be present on all exterior surfaces of a valve exposed to materials and/or components of a propulsion system at a different voltage potential relative to the substrate during operation. Of course instances in which sections of an exterior surface of the valve do not include the insulating layer are also contemplated. For example, electrical contacts, such as metallization layers, and/or bare sections of the substrate, may be present on portions of a substrate where the substrate is in contact with components and/or materials at substantially the same potential as the substrate. In either case, where the insulating layer is present on an exterior surface of the valve, which may include the surfaces of the through holes formed in the substrate, insulating layer may have any appropriate thickness to provide a desired amount of electrical insulation. An appropriate thickness of an insulating layer may be greater than or equal to 1 μm, 2 μm, 3 μm, and/or any other appropriate thickness. Correspondingly, the thickness of an insulating layer may be less than or equal to 5 μm, 4 μm, 3 μm, and/or any other appropriate thickness. Combinations of the above noted ranges of a thickness of an insulating layer are contemplated, including, for example, thicknesses between or equal to 1 μm and 5 μm. Of course, insulating layers with thicknesses both less than and greater than those noted above are possible depending on the particular insulating material used and the electrical potentials to be applied to a particular electrically actuated valve.

As noted previously, a valve may also include a hydrophobic layer disposed on at least a portion of an upstream surface of a valve contacting a propellant of a propulsion system prior to opening of the valve. In some embodiments, the hydrophobic layer may also be disposed on the surfaces of the through holes extending through a substrate and/or other portions of the substrate's exterior surface as the disclosure is not limited to only being disposed on specific portions of the substrate. Regardless, the hydrophobic layer may be more hydrophobic than the underlying substrate and insulating layer. However, embodiments in which a material functions as both an insulating layer, and a hydrophobic layer are also contemplated. Appropriate types of materials which may be used to form the hydrophobic layer may include, but are not limited to: fluoropolymers such as polytetrafluoroethylene (PTFE), fluorinated ethylene propylene (FEP), and amorphous fluoroplastics; hydrophobic silanes; rare-earth oxides such as cerium oxide; and combinations of the forgoing. Of course, it should be understood that any appropriate material exhibiting a desired hydrophobicity, and that is compatible with the propellant it will be in contact with, may be used to form the hydrophobic layer of a valve as the disclosure is not limited to any particular material.

In some embodiments, it may be desirable for a hydrophobic layer to be of sufficient quality to avoid the layer having defects, such as bare sections of substrate, which might affect the functionality of the hydrophobic layer in helping to prevent the unintentional wetting of the through holes of a valve with a propellant. Accordingly, a hydrophobic layer may have a sufficient thickness to provide a desired high-quality layer that exhibits a desired combination of surface properties for the valve. In some embodiments, a thickness of a hydrophobic layer disposed on a surface of a substrate contacting a propellant of the valve prior to actuation may be greater than or equal to 100 nm, 200 nm, 300 nm, and/or any other appropriate thickness. Correspondingly, a thickness of the hydrophobic layer may be less than or equal to 700 nm, 600 nm, 500 nm, 400 nm, and/or any other appropriate thickness. Combinations of the above ranges are contemplated, including, a thickness of an insulating layer that is between or equal to 100 nm and 700 nm. Of course embodiments in which a hydrophobic layer has a thickness either less than or greater than those noted above are also contemplated as the disclosure is not so limited.

As noted above, a hydrophobic layer deposited onto a substrate may also be located at least partially within the through holes formed in a substrate. Depending on the particular deposition process used, a thickness of the insulating layer within the through holes may vary along an axial length of the through holes. For example, a thickness of a hydrophobic layer on a surface of a through hole proximate a surface of the valve on which the hydrophobic layer is disposed may be approximately the same thickness as the hydrophobic layer on that surface. However, a thickness of the hydrophobic layer proximate a side of the valve opposite the side on which the hydrophobic layer is disposed may be less than a thickness of the hydrophobic layer on the surface of the valve contacting the propellant prior to actuation of the valve. In some embodiments, this thickness may be as little as about 10 nm. However, embodiments in which a hydrophobic layer does not extend all the way through the through holes of a valve, is not present within the through holes of a valve, or exhibits a uniform thickness along an axial length of the through holes are also contemplated as the disclosure is not limited in this fashion. In either case, the through holes of the valve may be open such that a propellant may flow through the valve once the through holes have been wet with a propellant of a propulsion system.

An electrically actuated valve as described herein may be designed to provide any desired flow rate for a desired application. Appropriate design parameters which may be considered when designing an electrically actuated valve for a particular flow rate may include, but are not limited to, through hole size, through hole density, aspect ratio of the through holes, and/or any other appropriate design parameter. Exemplary ranges for these parameters are provided below. However, it should be understood that ranges of these parameters both greater than and less than those noted below are contemplated as different propulsion systems may need flow rates that necessitate the use of different ranges of these design parameters.

In one embodiment, an aspect ratio of an axial length to a transverse dimension, such as a diameter, of the through holes of a valve may be greater than or equal to 1, 2, 5, 10, and/or any other appropriate ratio. Correspondingly, the ratio of an axial length to a transverse dimension of the through holes may be less than or equal to 30, 20, 10, 5, and/or any other appropriate ratio. Combinations of the foregoing ranges are contemplated, including, for example, a ratio of an axial length to a transverse dimension of the through holes may be between or equal to 1 and 30. While the above noted ranges may offer a desired balance of sufficiently low resistance to flow once wet as well as a desired resistance to wetting of the through holes prior to actuation, through holes with axial lengths and transverse dimensions with ratios both greater than and less than those noted above are also contemplated as the disclosure is not so limited.

The through holes formed in the valves described herein may have any appropriate transverse dimension, such as a diameter, for a desired application. In some embodiments, the through holes may have a transverse dimension that is greater than or equal to 0.5 μm, 1 μm, 5 μm, 8 μm, 10 μm, and/or any other appropriate transverse dimension. Correspondingly, a transverse dimension of the through holes may be less than or equal to 30 μm, 20 μm, 10 μm, and/or any other appropriate transverse dimension. Combinations of the above noted ranges are possible, including transverse dimensions of the through holes that are between or equal to 0.5 μm and 30 μm, 1 μm and 20 μm, 8 μm and 30 μm, and/or any other appropriate ranges of transverse dimensions including ranges both greater than and less than those noted above that when combined with the described hydrophobic layers selectively prevent the flow of propellant through the through holes prior to an electrical potential being applied to the valve to wet the through holes with the propellant.

A number and spacing of the through holes formed in a substrate may be balanced with the corresponding dimensions of the through holes to provide a desired flow rate of propellant through the valve during nominal operation. In one embodiment, an average center to center spacing of the through holes formed in a valve may be greater than or equal to 10 μm, 20 μm, 30 μm, and/or any other appropriate spacing. An average center to center spacing of the through holes may also be less than or equal to 100 μm, 50 μm, 30 μm, and/or any other appropriate spacing. Combinations of the above ranges are contemplated, including, for example, an average center to center spacing of the through holes between or equal to 10 nm and 100 and nm, 10 nm and 30 nm, and/or any other appropriate spacing both greater and less than those noted above depending on the particular through hole sizing and desired flow rate of the valve during nominal operation of a propulsion system. These through hole spacing ranges may be used in combination with the above noted through hole transverse dimension ranges and substrate thickness ranges.

Depending on the particular type of propulsion system the disclosed valves are incorporated into, different types of propellants may be used. Appropriate types of propellants the valves disclosed herein may be used with may include, but are not limited to, sources of ions such as an ionic liquid, a room-temperature molten salt, a combination of the foregoing, and/or any other appropriate propellant. Examples of ionic liquid and room temperature molten salt propellants may include, but are not limited to, EMI-BF4 (1-ethyl-3-methylimidazolium tetrafluoroborate), EMI-CF3BF3 (1-ethyl-3-methylimidazolium trifluoromethyltrifluoroborate), EMI-GaCl4 (1-ethyl-3-methylimidazolium tetrachlorogallate), EMI-Im (1-ethyl-3-methylimidazolium bis(trifluoromethylsulfonyl)imide), mixtures containing EMIF·2.3 HF (1-ethyl-3-imidazolium fluoride), BMI-BF4 (1-butyl-3-methylimidazolium tetrafluoroborate), BMI-CF3BF3 (1-butyl-3-methylimidazolium trifluoromethyltrifluoroborate), BMI-GaCl4 (1-butyl-3-methylimidazolium tetrachlorogallate), BMI-Im (1-butyl-3-methylimidazolium bis(trifluoromethylsulfonyl)imide), mixtures containing BMIF·2.3 HF (1-butyl-3-imidazolium fluoride), combinations of the foregoing, and other appropriate ionic liquid and/or room temperature molten salt propellants.

Depending on the particular application and design parameters, an electrically actuated valve as described herein may be actuated with any appropriate voltage potential. As described further in regards to the some embodiments below, this voltage potential may be applied to the substrate using the same power source used to operate a propulsion system and/or a separate power source as the disclosure is not limited in this fashion. In either case, an appropriate actuation voltage potential may be applied to actuate the valve to permit flow there through. In some embodiments, the voltage potential, and in some instances a larger voltage potential, may continue to be applied to the valve after actuation of the valve during nominal operation of the propulsion system. Exemplary voltage potentials which may be applied to a valve to wet the through holes of the valve may be greater than or equal to 50 V, 100 V, 500 V, and/or any other appropriate voltage potential. The voltage potential may also be less than or equal to 1500 V, 1000 V, 500 V, and/or any other appropriate voltage potential. Combinations of the above voltage potential ranges applied to a valve are contemplated, including, voltage potentials between or equal to 50 V and 1500 V and/or any other appropriate voltage potential including ranges both greater than and less than those noted above, as the disclosure is not limited to any particular range of voltages.

In some embodiments, once activated, an electrically actuated valve as described herein may remain open even when the voltage potential applied to the valve to wet the through holes and open the valve is removed. Thus, in some embodiments, the disclosed valves may be one-time valves that isolate a propellant from an associated thruster during storage and launch while permitting normal operation of the propulsion system once actuated without requiring the valve to be actively maintained in an open wetted configuration.

In some embodiments, it may be desirable to facilitate the flow to a valve from a propellant reservoir and/or from the valve to an associated thruster. Accordingly, in some embodiments, a wick material may be used to facilitate the flow of fluid between these various components of a propulsion system as described further below. It should be understood that any appropriate wick material may be used to passively feed propellant to and/or from one or more thrusters, outlets, emitter bodies, propellant reservoirs, one or more valves, and/or any other components of a propulsion system. In some embodiments, a wick may be made from a material that is configured such that the propellant may be continuously transported through capillarity through the wick. For example, propellant may be transported through capillarity from a reservoir, through a valve, and to a distal tip of an emitter body of a thruster so as to provide propellant without an active pump. Non-limiting examples of structures capable of functioning as a wick to passively transport propellant within a propulsion system may include, but are not limited to, materials such as glass fibers, paper fibers, porous materials, structures including grooves, cylindrical tubes, thin plate-shaped openings, a combination of the forgoing, and/or any other appropriate structure capable of transporting a propellant through capillary induced flow.

In some embodiments, a wick may include a pore size gradient such that the pores of the wick decrease in size in a direction along a flow path passing from the propellant reservoir towards a fluidly connected thruster. For example, in one embodiment, the one or more components of a propulsion system may be assembled such that a network of pores extends from the reservoir to a tip of an emitter body or bodies of a electrospray thruster. Further, to help facilitate the flow of propellant toward the outlet, in a propulsion system including one or more porous components, a pore size gradient across the one or more components may be selected such that the pore size of the different components decreases in a downstream direction directed towards the tip of one or more emitter bodies, or other appropriate outlet of a thruster of the propulsion system. In such an embodiment, the average pore size of upstream components may be larger than the average pore size of the associated downstream components.

While specific constructions and materials are noted above, it should be understood that any wick made from an appropriate material and/or including an appropriate structure capable of passively transporting propellant to a desired portion of a propulsion system may also be used as the disclosure is not so limited. Alternatively, embodiments in which propellant is actively fed to a thruster of a propulsion system using a pump or other active system after a valve has been opened are also contemplated. In embodiments in which a pump, or other component, is used to actively transport propellant from a reservoir to a thruster, the valve may be constructed to resist wetting when subjected to the pressures associated with active transport of the propellant and/or a pump, or other component, used to transport the propellant may not be operated until it is desired to actuate the valve and operate the system.

For the sake of clarity, the various embodiments described herein are primarily directed to propulsion systems including electrospray thrusters where one or more emitter bodies, including, for example, a plurality of emitter bodies arranged in an array, are operated to emit a stream of ions to produce thrust. However, it should be understood that an electrically-actuated valve as described herein may be used in any suitable propulsion system having any suitable propellant and/or thruster as the disclosure is not so limited.

Turning now to the figures, several non-limiting embodiments are described in further detail. However, it should be understood that the current disclosure is not limited to only those specific embodiments described herein. Instead, the various disclosed components, features, and methods may be arranged in any suitable combination as the disclosure is not so limited.

FIG. 1 depicts one embodiment of an electrically actuated valve 2. In the figure, the valve includes a substrate 4. As noted previously, the substrate may be made from a sufficiently conductive material to permit it to be polarized to a desired voltage potential relative to an associated propellant. The substrate includes a plurality of through holes 8 formed in the substrate that pass from a first side of the substrate 4*a* to a second opposing side of the substrate 4*b*. The valve may include an insulating layer 6 disposed on a surface of the substrate that may be exposed to a propellant and/or a component of a propulsion system which may be at a different voltage potential. In this case, the insulating layer is depicted as being disposed on the first and second opposing surfaces of the substrate that the through holes extend between. To avoid dielectric breakdown within the through holes, the insulating layer may also be disposed on the surfaces of the through holes as indicated by insulating layer 6*a* disposed on the surfaces of the through holes in the figure. Depending on the embodiment, the insulating layer may be located on one or more side surfaces of the substrate as well. Depending on the embodiment, the side surfaces may either be completely covered by the insulating layer and/or one or more electrical contacts may be formed on an appropriate portion of substrate that does not contact the propellant and/or other components at a different electrical potential during operation. For example, electrical contacts may be formed at one or more locations on a side of the substrate as depicted in the figure by the at least one metallization layer 12. Regardless of the location, the electrical contact disposed on the substrate may be used for making electrical contact between the substrate of the valve and a corresponding power source of a propulsion system as detailed below. In some instances, this electrical contact may be provided through a conductive support of a thruster connected to the metallization layer.

In some embodiments, each of the plurality of through holes 8 may include an undercut 8*a* proximate the insulating layer 6 on an upstream surface of the valve. The undercuts may correspond to a portion of a through hole that has a larger transverse dimension, e.g. a diameter, than an opening of the through hole through the insulating layer proximate the undercut and an adjacent portion of the through hole through the substrate 4. In some instances, this undercut may have a hemispherical and/or cone like shape. Without wishing to be bound by theory, the inclusion of an undercut in the through holes may help to prevent the unintended wetting of the through holes by a propellant of a propulsion system.

The valve of FIG. 1 may also include a hydrophobic layer 10 disposed on an upstream surface of the substrate 4 that may be exposed to a propellant prior to a voltage potential being applied to the substrate to open the valve. As shown in the figure, the hydrophobic layer may be disposed on the insulating layer 6 which is in turn disposed on the substrate on an upstream surface 4*a* of the substrate. The hydrophobic layer may also be disposed on the insulating layer 6*a* located within the through holes 8 as shown by hydrophobic layer 10*a* located in the through holes. However, while the hydrophobic layer is depicted as being present within the through holes, embodiments in which the hydrophobic layer is present only along a portion of a length of the through holes and/or is not present within the through holes are also contemplated. Additionally, while the hydrophobic layer is illustrated as being deposited onto only an upstream surface 4*a* of the valve and/or through holes, embodiments in which the hydrophobic layer is applied to other surfaces of the valve as well, including substantially all of the surfaces of the valve, are also contemplated as the disclosure is not limited to having the hydrophobic layer deposited onto only the upstream surface and/or through holes.

Figure 2A:
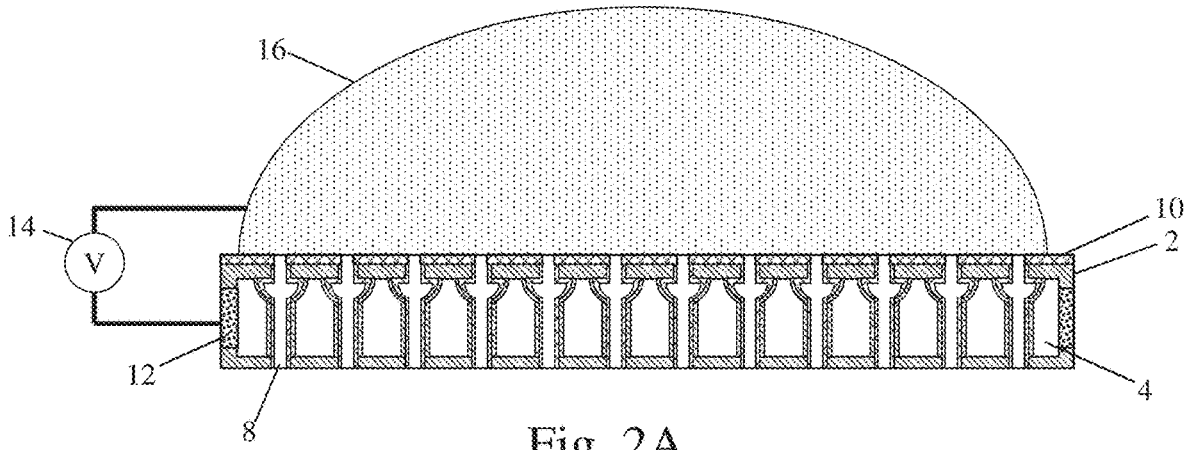
FIG. 2A is a schematic diagram of the electrically actuated valve in a non-wetted state.
Figure 2B:
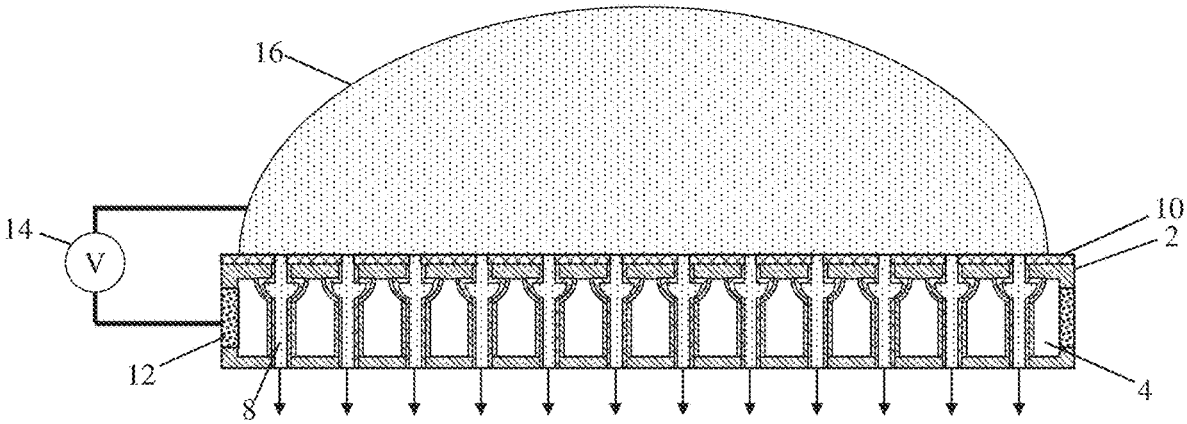
FIG. 2B is a schematic diagram of the electrically actuated valve of FIG. 2 in a wetted state.

FIG. 2A depicts an embodiment of an electrically actuated valve 2 including a plurality of through holes 8 similar to that described above relative to FIG. 1. In the depicted embodiment, a power source 14 is electrically connected to a substrate 4 of the valve via a metallization layer 12 functioning as an electrical contact that is electrically connected to the substrate. However, while the metallization layer may aid in forming a good electrical contact, and allow for soldering, embodiments, in which a metallization layer is not present are also contemplated. The power source is also electrically connected to a propellant 16 that is in contact with an upstream surface of the valve including the above described hydrophobic layer 10 and through holes. In the initial unactuated state, the propellant is maintained outside of the valve and the through holes are substantially free of, i.e. unwetted by, the propellant. FIG. 2B depicts the valve of FIG. 2A, after a voltage potential has been applied to the substrate by the power source. Specifically, the applied voltage potential biases the propellant to a sufficient degree such that it is able to overcome the resistance to wetting of the through holes with the propellant by the above described hydrophobic layer and through hole geometry. The propellant therefore has now wetted the through holes and is able to flow through the through holes of the valve as indicated by the depicted arrows. Due to the through holes now being wetted by the propellant, in some embodiments, even after the relative voltage potential is removed from the propellant and substrate of the valve, the through holes may remain wetted by the propellant, and the propellant may continue to flow through the valve.

Figure 3:
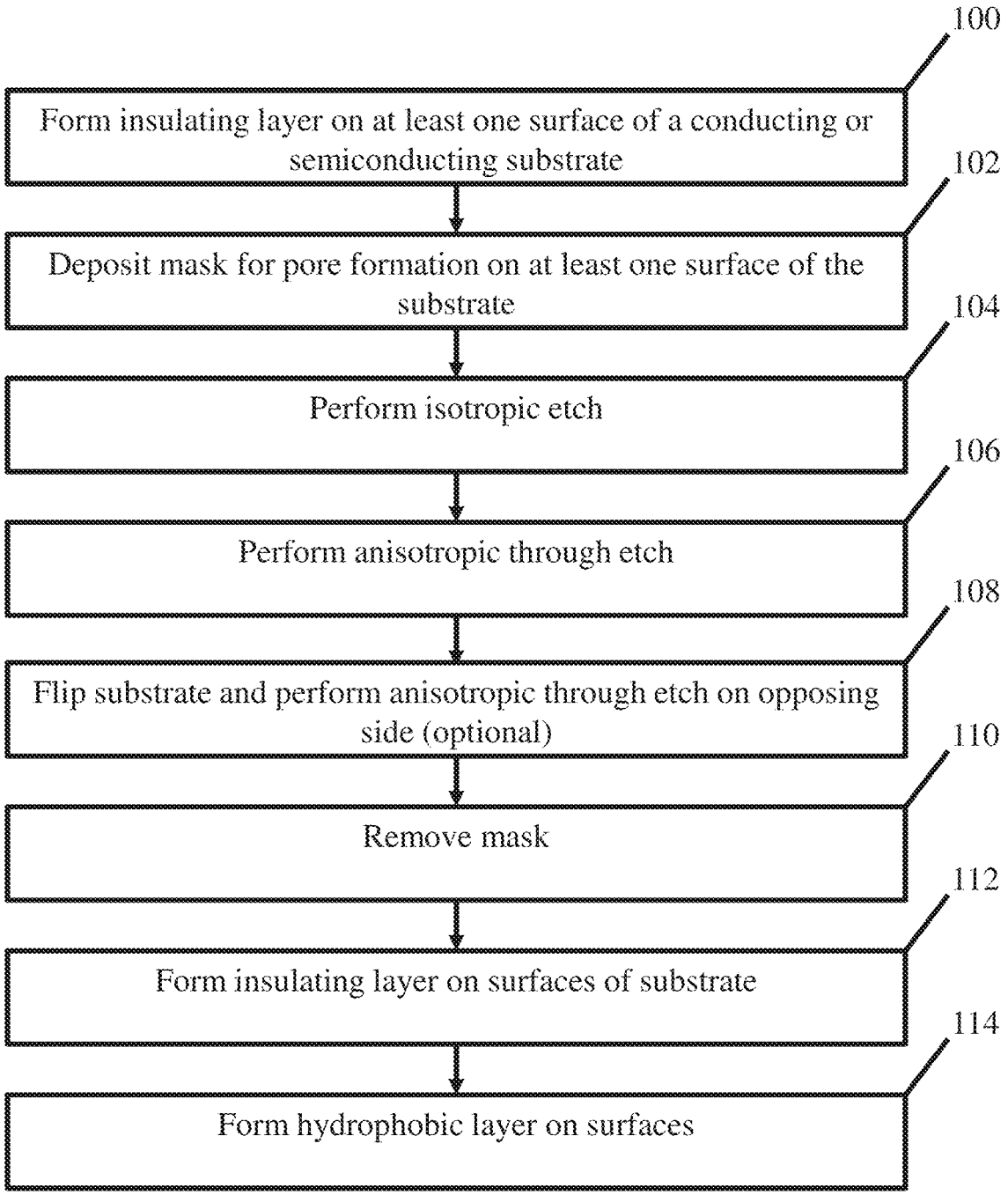
FIG. 3 is a flow diagram of one embodiment of a method for forming an electrically actuated valve.

FIG. 3 depicts one embodiment of a method for forming an electrically actuated valve as described herein. During an initial step, an insulating layer may be formed on at least one surface of a substrate at 100. For example, an insulating layer may be atomically deposited onto a top surface of the substrate. In some embodiments, this surface may be an upstream surface of the valve once completed. However, embodiments in which an insulating layer is formed on multiple surfaces of the substrate and/or using different deposition techniques are also contemplated. At 102 a mask may be deposited onto the at least one surface including the insulating layer. The mask may have any appropriate pattern for the formation of a desired arrangement and shape of a plurality of through holes in the substrate. Once the mask is appropriately patterned, an isotropic etch of the substrate may be performed at 104. Due to the isotropic etch etching in each direction equally, the etch may form an undercut beneath the insulating layer as described previously. Once an undercut of a desired size and shape has been formed, the isotropic etch may be discontinued and an anisotropic through etch may be performed at 106. In some embodiments, the anisotropic etch may be continued until the through holes extend through the substrate such that the through holes extend from one surface of the substrate to an opposing surface of the substrate. Alternatively, in instances where the substrate is relatively thick, a substrate may be flipped over and a mask may be applied to the opposing surface of the substrate and a subsequent anisotropic etch may be performed on the second surface at 108. The holes formed in the second surface are aligned with and connect with the holes formed in the first surface to form continuous through holes through the substrate. After forming the desired through hole geometries, the mask(s) may be removed using any appropriate method capable of removing the masks and that does not damage the underlying substrate and insulating layer at 110.

As noted above, if the surfaces of the through holes, and/or other portions of the substrate exposed to different voltage potentials, are not insulated, dielectric breakdown and shorting may occur within a valve during operation. Accordingly, a subsequent insulating layer may be formed on the surfaces of the substrate expected to be exposed to these voltage potentials during operation at 112. In some embodiments, the insulating layer may simply be formed on all surfaces of the substrate for ease of application and manufacture. However, embodiments in which the insulating layer is formed only on the through holes and other select portions of the substrate are also contemplated. Alternatively, portions of the substrate intended to be placed in electrical contact with a power source may be subjected to a subsequent processing steps for the formation of an electrical contact as the disclosure is not limited in this fashion. After forming the insulating layer on the desired surfaces of the substrate, a hydrophobic layer may be formed on at least an upstream surface of the substrate intended to be in contact with a propellant in an initial unactuated, or unwetted, state at 114. As described previously, the hydrophobic layer may also be formed such that it is disposed along at least a portion of, and in some embodiments, an entire, axial length of the through holes. However, embodiments in which the hydrophobic layer is formed on other surfaces of the substrate and/or is not located within the through holes themselves are also contemplated. Depending on the particular material selected from the hydrophobic layer, the layer may be deposited using any appropriate deposition method, including, but not limited to, chemical vapor deposition, physical vapor deposition, sputtering, electrochemical deposition, plasma-enhanced chemical vapor deposition, thermal/e-beam evaporation, atomic layer deposition, and/or any other appropriate deposition method depending on the particular material being deposited.

In the above embodiment, an isotropic etch may be performed using any appropriate method for a given substrate material. However, in some embodiments, appropriate isotropic etching methods may include: plasma etching with sulfur hexafluoride ($SF_6$) with no biasing voltage; etching with xenon difluoride ($XeF_2$); isotropic wet etching using any appropriate etchant, including, for example, HNA (a mixture of hydrofluoric, nitric, and acetic acid); a partially isotropic wet etch using tetramethylammonium hydroxide (TMAH), which has a 37:1 selectivity depending on the crystal plane, which may produce a steep-walled conical or pyramidal etch; and/or any other appropriate anisotropic etch capable of being used with a given substrate and insulating material.

Similar to the isotropic etch described above, any appropriate anisotropic etch may be used to form the through holes in a substrate. For example, in some embodiments, appropriate, anisotropic etches may include, but are not limited to: a Bosch deep reactive ion etch (DRIE) process which alternates $SF_6$ etching with $C_4F_8$ passivation steps; a potassium hydroxide wet etch, which exhibits a 400:1 crystal plane selectivity; and/or any other appropriate anisotropic etching method. Of course, while the use of an anisotropic etching method may be beneficial, in some embodiments, the above-noted isotropic etch may be used exclusively to produce the desired through holes. Through holes formed in such a manner may exhibit a constantly changing transverse dimension along their length. This may present challenges relative to controlling the dimension of the through holes proximate the insulating layer and hydrophobic layer on an upstream surface of a valve. However, such a method may simplify the overall manufacturing process of a valve.

While the use of etching processes are described above, in instances where difficult to etch materials are used, different processes may be used to form the desired through holes. For example, ion beam milling may be used in some embodiments to form the desired through holes in a substrate. Alternatively, in some embodiments, electrochemical etching may also be used on certain substrate such as metallic or other sufficiently conductive substrates to form the desired through holes.

It should be understood that any appropriate method of forming an oxide, or other insulating layer such as a nitride, on the exposed surfaces of a substrate, including in some embodiments the exposed surfaces within the through holes of a substrate, may be used. For example, in certain embodiments, an oxide layer may be formed on one or more surfaces of the substrate as described above, using: a wet thermal oxidation process where a mixture of hydrogen and oxygen at temperatures greater than 1000° C. form steam and the water vapor may diffuse rapidly into a substrate, such as silicon, more rapidly than does molecular oxygen; a dry thermal oxidation process where a substrate is exposed to a substantially pure oxygen atmosphere at a similarly elevated temperatures greater than about 1000° C.; a chemical vapor deposition process with no biasing voltage applied to produce a conformal coating; anodic oxidation of a metallic substrate; and/or any other appropriate oxidation method as the disclosure is not limited in this fashion.

Any appropriate type of mask may be applied to a substrate to form a desired pattern of through holes in the substrate. For example, in some embodiments, a mask used to pattern a substrate may include, but is not limited to, glass mask, polymer mask, metallic mask, and/or any other appropriate type of mask. Further, in some embodiments, a mask, and the methods used to remove the mask from the substrate, may be selected to be compatible with the substrate and insulating layers disposed thereon such that the substrate and insulating layers are not damaged during mask application and removal. However, embodiments in which a mask is not used when forming the desired through holes are also contemplated. In one such embodiment, a laser rastering system may be used to form the desired plurality of through holes in a substrate.

Figure 4:
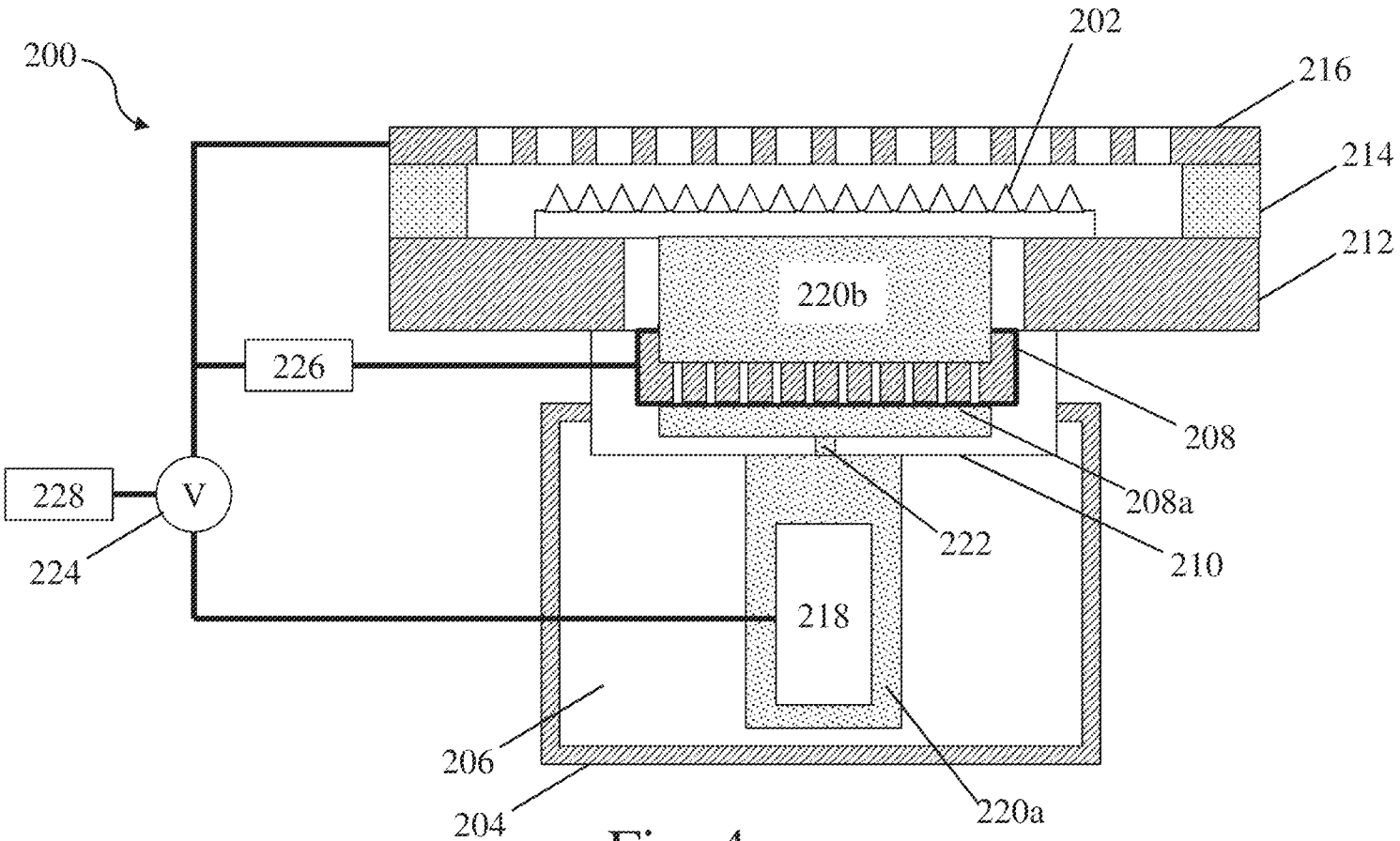
FIG. 4 is a schematic diagram of one embodiment of a propulsion system.
Figure 5:
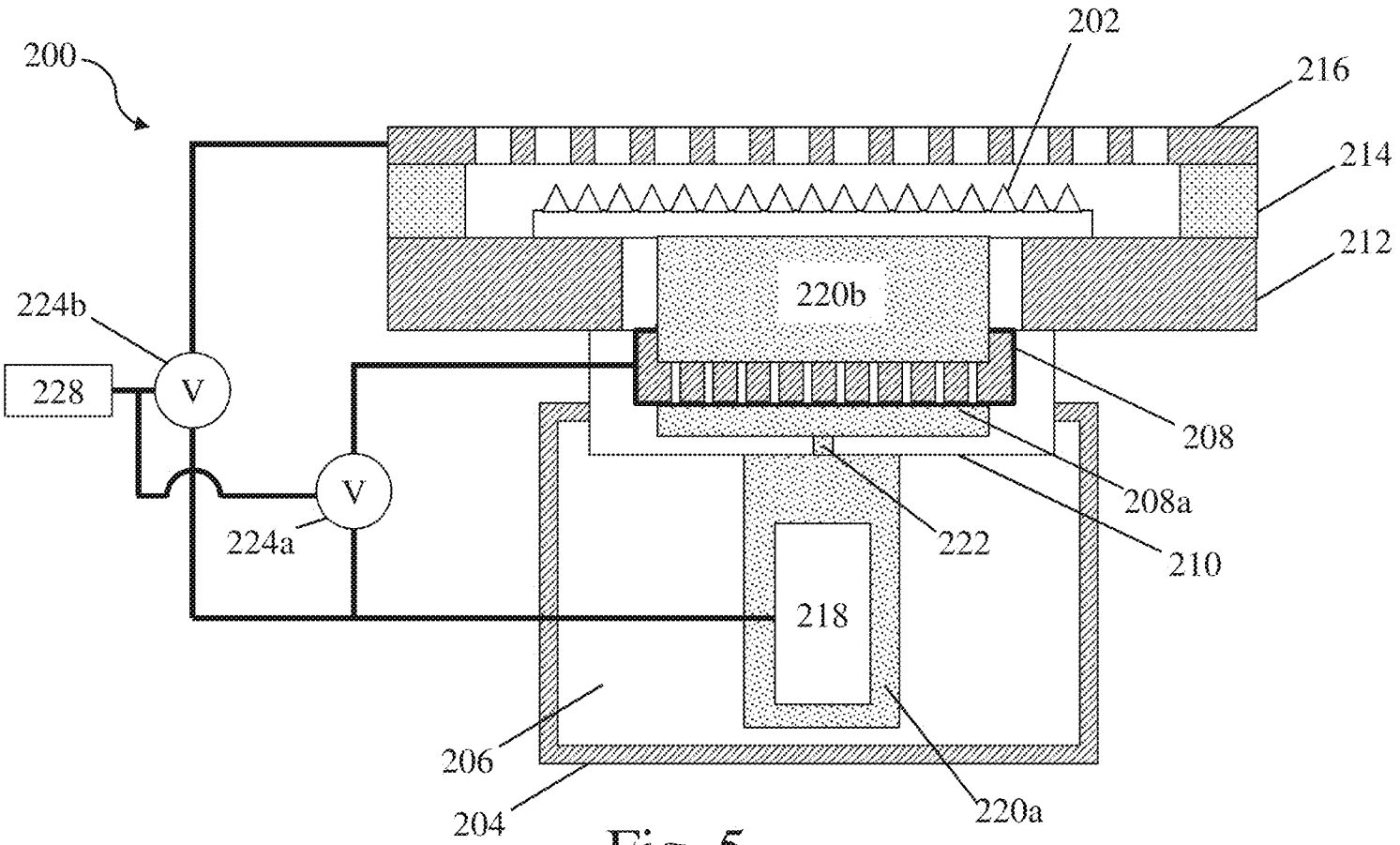
FIG. 5 is a schematic diagram of one embodiment of a propulsion system.
Figure 6:
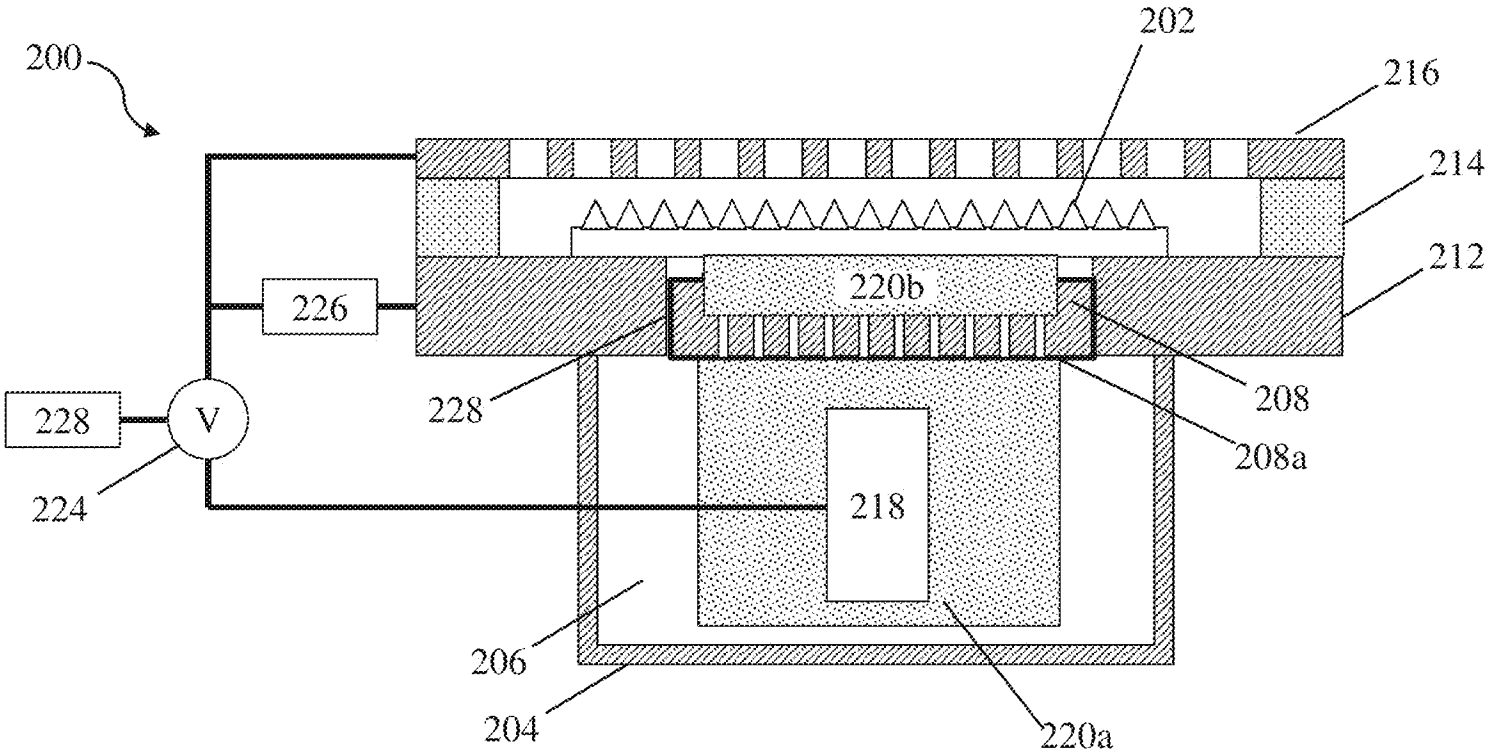
FIG. 6 is a schematic diagram of one embodiment of a propulsion system.

FIGS. 4-6 depict various embodiments of a propulsion system 200. As shown in the figures, a propulsion system may include one or more thrusters 202, a reservoir 204, a propellant 206 contained in the reservoir, and an electrically actuated valve 208 as described herein. The valve may be disposed between the reservoir and the thruster such that a flow path extending from the reservoir to the thruster extends through the valve. In some embodiments, it may be desirable to provide redundant valves in series with one another such that the flow path extends through the plurality of valves from a downstream reservoir to an upstream thruster. Regardless of the specific number of valves, an upstream surface 208*a* of each valve including the hydrophobic layer described above intended to selectively prevent the flow of propellant may be oriented in an upstream direction along the flow path towards the reservoir to permit the valve to selectively prevent a flow of the propellant through the one or more valves to the associated thruster.

In the depicted embodiment, the thruster 202 may be an electrospray thruster including an array of emitter bodies that may emit streams of ions from their distal downstream tips during operation. The thruster may be disposed on any appropriate support 212, which may be a silicon substrate, though embodiments in which the support is insulating, semiconducting, or conducting are contemplated depending on where and how the desired electrical potentials are applied to the thruster during operation. The propulsion system may also include an extractor electrode 216 that is positioned downstream from the electrospray thruster. The extractor electrode may be made from a conducting or semiconducting material capable of applying a voltage potential relative to the electrospray thruster. Further the extractor electrode may be disposed on a spacer 214 which is disposed on the support. The spacer may be made from a sufficiently insulating material and may have appropriate dimensions to maintain the extractor electrode electrically isolated from the thruster support and electrospray thruster itself.

The depicted propulsion system also includes at least one power source 224. The at least one power source may be electrically connected to both the extractor electrode 216 and the propellant 206. The electrical contact between the power source and the propellant may be through an electrode, which in some embodiments may be a porous electrode, disposed within the reservoir 204. However, embodiments in which the power source is in electrical contact with the propellant through the thruster itself, along a portion of the flow path extending between the reservoir and thruster, and/or through a solid electrode are also contemplated as the disclosure is not limited to where or how the power source is electrically connected to the propellant. In either case, application of a voltage potential between the propellant and the extractor electrode during normal operation of the thruster 202 may result in a stream of ions being emitted from the depicted electrospray thruster.

As best shown in FIG. 4, in some embodiments, the at least one power source 224 is also electrically connected to a substrate of the depicted one or more valves 208 which may include a plurality of through holes and a corresponding hydrophobic surface on an upstream surface 208*a* of the valve intended to contact the propellant prior to being opened. This electrical contact between the power source and the substrate of the valve as well as the electrical contact between the power source and the propellant upstream from the valve permit the power source to apply an electrical potential to the valve relative to the propellant.

Due to the disclosed propulsion systems being used in space applications where there is likely insufficient gravity present to aid in the positioning and flow of propellant within the propulsion system, it may be desirable to provide either passive and/or active means for helping promote the transport of a propellant 206 from a reservoir 204 to the associated thruster 202 described above. In one such embodiment, one or more wicks 220 may be present within the reservoir and/or along a flow path between the reservoir and the thruster to promote the passive flow of propellant from the reservoir to the thruster through the one or more wicks via capillary flow. For example, as shown in FIGS. 4-6, a first wick 220*a*, made from any of the materials and/or structures described herein, may be disposed within the reservoir and may extend up to a location proximate, and in some embodiments in contact with, an upstream hydrophobic surface 208*a* of one or more electrically actuated valves 208 as described here. Thus, propellant may be transported from the reservoir to the upstream surface of the valve through the first wick. Correspondingly, a second wick 220*b* may extend from a downstream surface of the valve to an upstream surface of the thruster 202 and/or a component in fluid communication with the thruster. Thus, the reservoir may be in fluid medication with the valve through the first wick and the valve may be in fluid communication with the thruster through the second wick. Of course embodiments in which wicks are not present in one or more of these locations and the propellant flows along the flow path due to other biasing mechanisms such as pumps and/or over pressures are also contemplated as the disclosure is not limited in this fashion.

Depending on the particular embodiment, the one or more valves 208 described herein may either be formed separately and integrated with a thruster 202 and/or they may be integrally formed with at least a portion of the thruster as the disclosure is not limited to where and/or how a valve is integrated into a propulsion system 200. Embodiments related to both of these separate types of propulsion systems are described further below.

FIGS. 4 and 5 depict one embodiment where a separately formed valve 208 has been integrated into a propulsion system 200. In the depicted environment, a separately manufactured valve is disposed in a recess formed in a valve base 208. The resulting structure may have a cup like shape that receives and supports the valve in a desired location. The valve and supporting valve base are disposed at a location between the reservoir 204 and corresponding thruster 202. Depending on the particular embodiment, the valve base may include one or more apertures 222 on an upstream portion of the valve base to provide fluid communication between the reservoir and the valve. To facilitate this fluid communication, in some embodiments, a first wick 220*a* may be present within both the reservoir, the one or more apertures formed in the valve base, and within a space between the upstream hydrophobic surface of the valve 208*a* and an interior surface of the valve base oriented towards the upstream hydrophobic surface of the valve. This may help facilitate the transport of propellant from within the reservoir to the various portions of the valve. Depending on the particular embodiment, the valve base may be made from a solid material compatible with the propellant, a porous material that is non-wettable by the propellant (e.g. porous polytetrafluoroethylene), and/or any other appropriate material. Of course, while an embodiment of a valve base including one or more apertures is described above, embodiments in which an upstream portion of the valve base is simply open to the reservoir are also contemplated as the disclosure is not so limited.

FIG. 6 depicts another embodiment of a valve 208. In this embodiment, the valve is integrated directly into a support 212 of a thruster 202. Depending on the particular embodiment, the valve may be formed separately and the sides of the valve may be connected to a corresponding opening in the support. Alternatively, a valve may be directly formed in the support itself. In instances where the support is either semiconducting or conducting, the substrate of the valve may be electrically connected to the support at an interface 228 using any appropriate electrical connection. For example, in instances where a separate valve is disposed within and connected to an opening in the support of the thruster, a metallization layer may be used to both physically attach and electrically connect the substrate of the valve to the surrounding support. Additionally, in instances where the valve is integrally formed with the support, no further separate electrical connection may be needed due to the substrate of the valve being integrally formed with the semiconducting and/or conducting material of the support. In either case, a power source 224 may be electrically connected to the substrate of the valve through the thruster support and/or any other appropriate component of the propulsion system that the valve is integrated with and/or connected to. As depicted in the figure, in some embodiments, the hydrophobic upstream surface 208*a* of the valve may be in direct contact with the propellant 206 and/or a wick 220*a* disposed within the reservoir 204. However, embodiments in which a separate structure, such as the valve base described above, including one or more apertures formed therein is included in a propulsion system to separate the depicted valve from the reservoir are also contemplated.

Gases trapped and/or dissolved in a reservoir may outgas once a propulsion system is deployed. This may result in an undesired over pressurization of a reservoir which may correspondingly result in excessive flow rates of propellant from the reservoir to an associated thruster. Accordingly, in some embodiments, it may be desirable to throttle the flow of propellant at faster flow rates at least above a threshold flow rate. In one such embodiment, a propulsion system 200 may include one or more apertures 222, or other appropriate flow restriction, formed in a valve base 210, or other appropriate structure, disposed along a flow path extending between the reservoir and the thruster, see FIGS. 4 and 5. As noted previously, the valve base may be made from either a solid material and/or a porous material that is not wettable by the propellant. Accordingly, the flow of fluid from the reservoir to the thruster may be restricted to flowing through the flow restriction. Further, in this embodiment, the one or more flow restrictions may be appropriately sized and shaped to provide a desired flow resistance to at least partially restrict the flow of propellant through the one or more apertures above a threshold flow rate while still providing a desired minimum flow rate of propellant through the flow path in instances were over pressurization of the reservoir is not present.

When a propulsion system operates at sufficiently high voltage potentials, it may be challenging to grow insulating layers which are sufficiently thick to avoid dielectric breakdown which may result in short-circuiting of a propulsion system during operation. To avoid such a situation occurring, it may be desirable to control the voltage potentials applied within a system and/or to mitigate the buildup of charge between various components of a system to mitigate the potential for shorting to occur within a propulsion system. Several different strategies for controlling the electrical systems of a propulsion system are detailed below in regards to the embodiments of FIGS. 4-6.

In FIGS. 4 and 6, a power source 224 is used to open the one or more valves 208 and operate the thruster 202 of a propulsion system 200. Specifically, the power source is in electrically connected with the propellant 206 within a reservoir 204 via an electrode 218 disposed therein and/or along another portion of the flow path extending between the reservoir and the valve. The power source is also electrically connected to the extractor electrode 216 of the thruster 202. In this embodiment, the substrate of the valve 208 is electrically connected to the power source along the same electrical connection as the extractor electrode. Thus, the voltage potential applied to the valve during valve actuation and normal operation of the thruster may be the same as the voltage potential applied to the extractor electrode. Accordingly, in some embodiments, the valve may be electrically connected to the power source through an electrical component 226, such as a switch and/or a shunt resistor, to control the relative potential of the valve relative to the propellant and other components of the system. In embodiments in which a switch is used, the switch may be closed to apply a desired voltage potential to the valve relative to the propellant to initiate flow through the valve. The switch may then be opened to disconnect the valve from the power source and remove the voltage potential applied to the valve. Alternatively, in instances where a shunt resistor is used, the voltage potential applied to the extractor electrode during initial valve actuation and during normal operation of the thruster will also be applied to the valve. However, the shunt resistor may permit accumulated charge on the valve to be appropriately discharged to the power source and/or extractor electrode through the shunt resistor to avoid potential electrical shorting within the system.

In another embodiment shown in FIG. 5, a propulsion system may include a first power source 224*a* as described above as well as a separate second power source 224*b*. Similar to the embodiments of FIGS. 4 and 6, both power sources may be electrically connected to the propellant 206 within the reservoir via an electrode 218 disposed therein. The first power source may also be electrically connected to a substrate of the valve 208 disposed between the propellant in the reservoir and the associated thruster 202. Correspondingly, the second power source may be electrically connected to the extractor electrode 216 of the thruster. Thus, the first power source may be selectively operated to apply a desired voltage potential to the valve relative to the propellant to actuate the valve by wetting the through holes formed in the valve to permit the flow of propellant through the system. The voltage potential applied by the first power source may then be discontinued after the valve has been actuated. Correspondingly, when it is desired to initiate normal operation of the propulsion system, the second power source may apply a voltage potential to the extractor electrode relative to the thruster and/or propellant to emit a stream of ions from the thruster. While such a system does use multiple separate power sources, it does beneficially avoid the application of large electrical potentials to the valve during thruster operation.

It should be understood that while the various electrical component and power source arrangements have been described relative to different embodiments, the electrical component and power source arrangements may be used with any appropriate arrangement of the propulsion systems and corresponding valves described herein as the disclosure is not limited to only the specific embodiments described herein.

In some embodiments the propulsion systems of FIGS. 4-6 may also include one or more controllers 228 which are operatively connected to the various power sources 224, 224*a*, or 224*b* and/or electrical components 226, such as a switch, of a propulsion system 200 described in the various embodiments above. The one or more controllers may include at least one processor and associated non-transitory computer readable storage medium which may store instructions that when executed by the at least one processor change one or more operating states of the various power sources, electrical components, and/or other appropriate components of a propulsion system to actuate the electrically actuated valves to initiate flow of a propellant from a reservoir through the valve and to a thruster prior to commencing nominal operation of the one or more thrusters of the propulsion system as described herein.

Prior to actuation of the valves disclosed herein, a hydrophobic upstream surface 208*a* of a valve 208 may prevent the flow of a propellant 206 contained in a reservoir 204 from flowing along a flow path through the valve to an associated thruster 202 as described above. Depending on the particular embodiment, during operation, a power source, such as power source 224 in FIGS. 4 and 6 or 224*a* in FIG. 5, may apply a voltage potential relative to a substrate of the valve and the propellant within the reservoir. The applied voltage potential may result in the propellant wetting a plurality of through holes extending from the hydrophobic upstream surface of the valve to a downstream surface of the valve. This may place the propellant in the reservoir in fluid communication with the thruster through the now actuated valve. Depending on the particular embodiment, the voltage potential may then be removed from the substrate of the valve, or may be continued to be applied either continuously and/or intermittently, depending on the particular method of operating the thruster of the propulsion system. For example, in the embodiment of FIGS. 4 and 6, the above described electrical component 226, such as a shunt resistor, may result in the same voltage potential being applied to the extractor electrode of the thruster and the valve. Alternatively, in instances when electrical component is an electrical switch, the switch may be selectively opened or closed to selectively electrically connect and disconnect the valve with the associated power source. Alternatively, as shown in FIG. 5, and as described above, a separate power source 224*b* may be used to apply the desired voltage potential to the valve which may then be removed after the valve has been actuated. In either case, after the valve has been actuated to place the reservoir in fluid communication with the associated thruster through the valve, a voltage potential may be applied to an extractor electrode 216 of the thruster relative to the propellant and/or electrospray thruster. This may result in the emission of a stream of ions from the thruster during nominal operation of the propulsion system.

Figure 7:
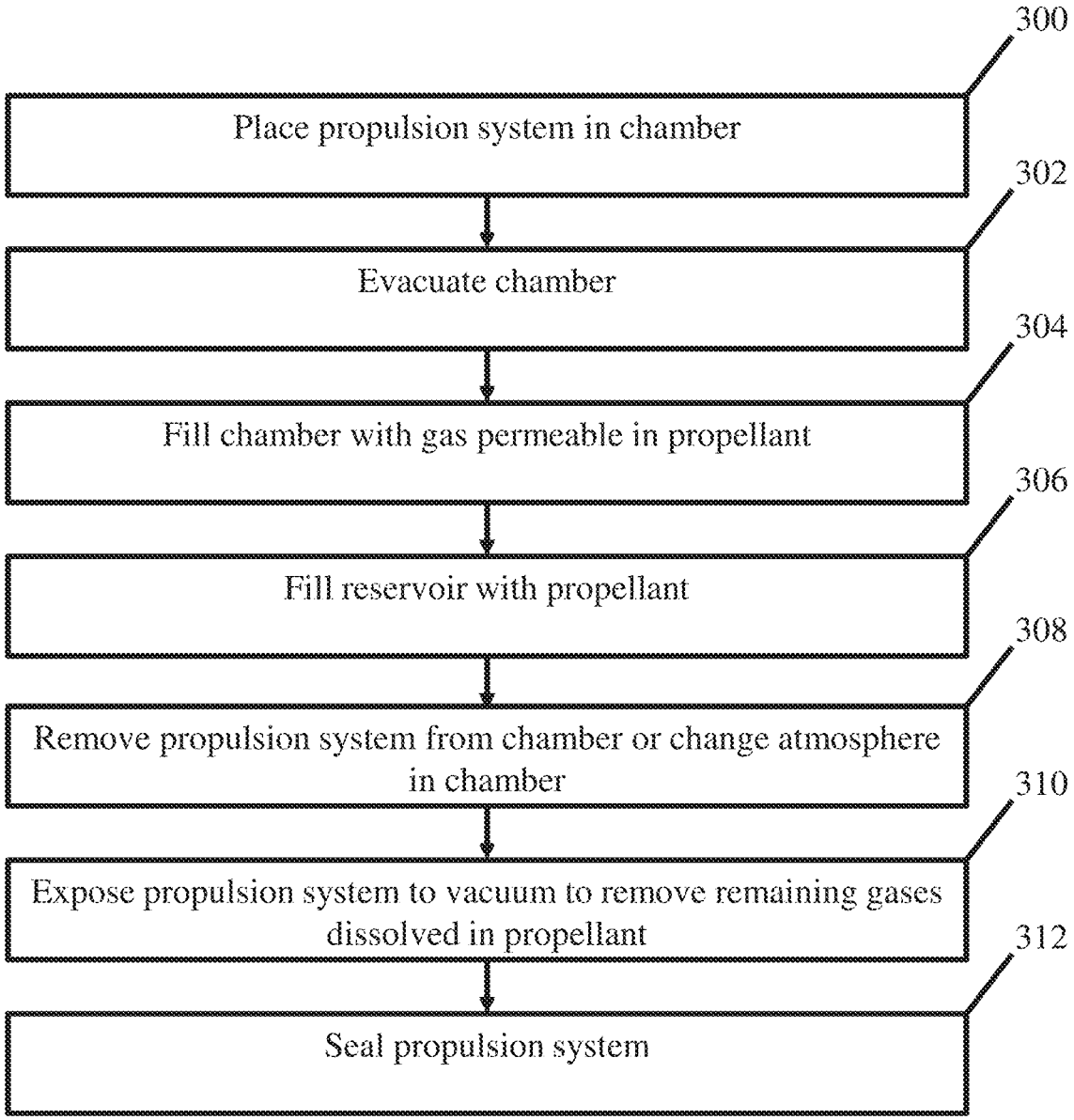
FIG. 7 is a flow diagram of one embodiment for sealing a propulsion system.

As noted above, the presence of gases entrapped in a propulsion system that are not permeable within a propellant of the propulsion system may result in over pressurization when the propulsion system is deployed into a vacuum since these gases may become trapped and are unable to diffuse away through the propellant. Accordingly, in some embodiments, construction and filling methods may be used to help limit and/or remove gases that are not permeable within a propellant of the system to minimize the presence of these gases being entrapped within the propulsion system which may help to minimize the occurrence of over pressurization events. FIG. 7 depicts one embodiment of a method for filling a propulsion system. The propulsion system may be placed in a chamber at 300 prior to the chamber been evacuated at 302 using, for example, a vacuum pump to remove gases from the chamber. The pressure within the chamber may be sufficiently low and held for a sufficiently long time to remove gases trapped in the various components of the propulsion system including, for example, the wicks, electrodes, walls, valves, electrospray thrusters, porous components, and/or any other appropriate component of a propulsion system. After removing gases from the chamber and the propulsion system, the chamber may be flooded with a gas that is permeable to a propellant that is to be used with the propulsion system at 304. For example, carbon dioxide is permeable in many ionic liquids though any appropriate gas permeable in the desired propellant may be used. The chamber may be filled to any desired pressure and left for an appropriate time to ensure proper distribution of the permeating gas atmosphere to the various components of the propulsion system. A reservoir of the propulsion system may then be filled with the propellant at 306. Depending on the particular construction, the propellant may be input through a filling port located on any appropriate section of the reservoir. Alternatively, in some embodiments, the reservoir may be filled prior to the valve and thruster being assembled with reservoir while disposed in the permeating gas atmosphere.

After filling a reservoir with a desired propellant, a propulsion system may be removed from a chamber and/or the chamber's atmosphere may be changed such that the new atmosphere has a lower partial pressure of the permeating gas relative to the atmosphere used while filling the reservoir at 308. For example, the propulsion system may simply be exposed to normal atmosphere and/or to any other desired atmosphere that contains a non-permeating gas relative to the propellant. The propulsion system may be the stored in this non-permeating gas environment for an appropriate amount of time for the permeating gas dissolved in the propellant to desorb from the propellant and diffuse out of the propulsion system. After this initial desorption of the permeating gas from the propellant, the propulsion system may be placed back into a chamber and the propulsion system may be exposed to a vacuum at 310 to permit the remaining gas dissolved in the propellant to desorb and diffuse out of the propulsion system.

After removing the potential sources of entrapped gases within a propulsion system using the steps described above, a propulsion system may be sealed at 312 using any appropriate sealing method as the disclosure is not limited to how a propulsion system is isolated from a surrounding environment during storage and or launch. In some embodiments, the propulsion system may subsequently be exposed to vacuum and/or shaking tests with a profile similar to that experienced during a space launch to ensure integrity of the propulsion system, both visually and/or through various measurements (e.g. electrical measurements, and/or any other appropriate measurements for a particular propulsion system). In either case, the above described method may help to prevent the occurrence of over pressurization events occurring during launch and/or deployment of a propulsion system due to gases being entrapped within various components of the propulsion system.

The above-described embodiments of the technology described herein can be implemented in any of numerous ways. For example, the embodiments may be implemented using hardware, software or a combination thereof. When implemented in software, the software code can be executed on any suitable processor or collection of processors, whether provided in a single computing device or distributed among multiple computing devices. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Further, it should be appreciated that a computing device may be embodied in any of a number of forms, such as a rack-mounted computer, a desktop computer, a laptop computer, or a tablet computer. Additionally, a computing device may be embedded in a device not generally regarded as a computing device but with suitable processing capabilities, including a Personal Digital Assistant (PDA), a smart phone, tablet, or any other suitable portable or fixed electronic device.

Also, a computing device may have one or more input and output devices. These devices can be used, among other things, to present a user interface. Examples of output devices that can be used to provide a user interface include display screens for visual presentation of output and speakers or other sound generating devices for audible presentation of output. Examples of input devices that can be used for a user interface include keyboards, individual buttons, and pointing devices, such as mice, touch pads, and digitizing tablets. As another example, a computing device may receive input information through speech recognition or in other audible format.

Such computing devices may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the embodiments described herein may be embodied as a computer readable storage medium (or multiple computer readable media) (e.g., a computer memory, one or more floppy discs, compact discs (CD), optical discs, digital video disks (DVD), magnetic tapes, flash memories, RAM, ROM, EEPROM, circuit configurations in Field Programmable Gate Arrays or other semiconductor devices, or other tangible computer storage medium) encoded with one or more programs that, when executed by one or more processors, perform methods that implement the various embodiments discussed above. As is apparent from the foregoing examples, a computer readable storage medium may retain information for a sufficient time to provide computer-executable instructions in a non-transitory form. Such a computer readable storage medium or media can be transportable, such that the program or programs stored thereon can be loaded onto one or more different computing devices or other processors to implement various aspects of the present disclosure as discussed above. As used herein, the term "computer-readable storage medium" encompasses only a non-transitory computer-readable medium that can be considered to be a manufacture (i.e., article of manufacture) or a machine. Alternatively or additionally, the disclosure may be embodied as a computer readable medium other than a computer-readable storage medium, such as a propagating signal.

The terms "program" or "software" are used herein in a generic sense to refer to any type of computer code or set of computer-executable instructions that can be employed to program a computing device or other processor to implement various aspects of the present disclosure as discussed above. Additionally, it should be appreciated that according to one aspect of this embodiment, one or more computer programs that when executed perform methods of the present disclosure need not reside on a single computing device or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

The embodiments described herein may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Example: An Electrowetting Valve

An electrowetting valve was fabricated using a silicon substrate with a plurality of through-holes fabricated using the methods described above. First, a 1 μm thick layer of silicon dioxide was deposited onto a surface of the silicon substrate using chemical vapor deposition prior to forming a mask and performing an isotropic etch and anisotropic etch to form through holes having a shape similar to that shown in FIG. 1. Valves were tested with through holes having nominal diameters ranging between of about 8 μm and 30 μm were grown with a center to center spacing of about 30 μm. Subsequent to through hole formation, a silicon dioxide layer was thermally grown on a surface of the silicon substrate, including the surfaces of the through-holes to serve as an electric isolator. In addition, a hydrophobic layer comprising a fluoropolymer (e.g. polytetrafluoroethylene) was applied to the silicon dioxide covering all surfaces of the silicon, both native and thermally grown, to prevent wetting of a surface of the substrate with a propellant. The non-wetting fluoropolymer layer was applied to the surface using chemical vapor deposition with a thickness of about 400 nm. This structure was found to exhibit excellent properties for fluid flow prevention, i.e. generating non-wetting contact angles with ionic liquids larger than 90 degrees.

From testing of the manufactured valves, the Inventors found that through holes 20 μm in diameter or smaller were advantageous in some embodiments, and for certain propellants, because the capillary pressure was sufficiently high to prevent flow of propellant under storage and launch load conditions. However, the use of through holes with diameters larger than this range are also envisioned as the use of different propellants and materials may result in different optimal through hole size ranges.

Testing of the manufactured valves also confirmed a sufficient flow rate of propellant into a thruster (e.g., an electrospray thruster) upon activation. Sufficient propellant flow rate upon activation was verified both visually and through electrical measurements by characterizing electrical current transport properties through the thruster using a downstream probe electrode.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are way of example only.

What is claimed is:

1. A propulsion system comprising:

a reservoir containing a propellant;

a thruster;

at least one valve disposed between the reservoir and the thruster, wherein the at least one valve includes a first plurality of through holes extending from a first side of the at least one valve to a second side of the at least one valve opposite the first side; and a first power source electrically connected to the propellant and the at least one valve, wherein in a first initial operating mode the first plurality of through holes of the at least one valve are substantially free of the propellant, and wherein in a second operating mode the first power source applies a voltage potential to the at least one valve relative to the propellant to wet the first plurality of through holes of the at least one valve with the propellant to place the reservoir in fluid communication with the thruster.

2. The propulsion system of claim 1, wherein the at least one valve comprises:

a substrate comprising the first plurality of through holes;

an insulating layer disposed on the substrate and disposed on a surface of the through holes; and a hydrophobic layer disposed on at least an upstream surface of the substrate, wherein the hydrophobic layer is more hydrophobic than the insulating layer and the substrate, and wherein the hydrophobic layer is disposed on the insulating layer.

3. The propulsion system of claim 2, wherein the hydrophobic layer comprises a fluoropolymer.

4. The propulsion system of claim 2, wherein the substrate is conductive and/or semiconducting.

5. The propulsion system of claim 1, wherein the propellant is at least one selected from the group of an ionic liquid and a room temperature molten salt.

6. The propulsion system of claim 1, further comprising a shunt resistor, wherein the first power source is connected to a substrate of the at least one valve through the shunt resistor.

7. The propulsion system of claim 1, further comprising a switch configured to selectively connect the first power source to a substrate of the at least one valve.

8. The propulsion system of claim 1, further comprising a second power source electrically connected to the propellant and the thruster.

9. The propulsion system of claim 1, wherein the at least one valve further comprises at least one metallization layer that electrically connects a substrate of the at least one valve to a conductive support of the thruster, and wherein the first power source is electrically connected to the conductive support of the thruster.

10. The propulsion system of claim 1, wherein the at least one valve is a plurality of valves disposed between the reservoir and the thruster.

11. The propulsion system of claim 1, wherein the thruster is an electrospray thruster.

12. A propulsion system comprising:

a reservoir containing a propellant;

a thruster;

at least one valve disposed between the reservoir and the thruster, the at least one valve comprising:

a substrate comprising a plurality of through holes;

an insulating layer disposed on the substrate and disposed on a surface of the through holes; and a hydrophobic layer disposed on at least an upstream surface of the substrate, wherein the hydrophobic layer is more hydrophobic than the insulating layer and the substrate, and wherein the hydrophobic layer is disposed on the insulating layer; and a first power source electrically connected to the propellant and the at least one valve.

13. The propulsion system of claim 12, wherein in a first initial operating mode the plurality of through holes of the at least one valve are substantially free of the propellant, and wherein in a second operating mode the first power source applies a voltage potential to the at least one valve relative to the propellant to wet the plurality of through holes of the at least one valve with the propellant to place the reservoir in fluid communication with the thruster.

14. The propulsion system of claim 12, wherein the hydrophobic layer comprises a fluoropolymer.

15. The propulsion system of claim 12, wherein the substrate is conductive and/or semiconducting.

16. The propulsion system of claim 12, wherein the propellant is at least one selected from the group of an ionic liquid and a room temperature molten salt.

17. The propulsion system of claim 12, further comprising a shunt resistor, wherein the first power source is connected to the substrate of the at least one valve through the shunt resistor.

18. The propulsion system of claim 12, further comprising a switch configured to selectively connect the first power source to the substrate of the at least one valve.

19. The propulsion system of claim 12, further comprising a second power source electrically connected to the propellant and the thruster.

20. The propulsion system of claim 12, wherein the at least one valve further comprises at least one metallization layer that electrically connects the substrate of the at least one valve to a conductive support of the thruster, and wherein the first power source is electrically connected to the conductive support of the thruster.

21. The propulsion system of claim 12, wherein the at least one valve is a plurality of valves disposed between the reservoir and the thruster.

22. The propulsion system of claim 12, wherein the thruster is an electrospray thruster.

* * * * *